US010626856B2

(12) United States Patent
Coldren et al.

(10) Patent No.: US 10,626,856 B2
(45) Date of Patent: Apr. 21, 2020

(54) CRYOGENIC FLUID PUMP

(71) Applicant: Caterpillar Inc., Peoria, IL (US)

(72) Inventors: Dana R. Coldren, Secor, IL (US); Dennis H. Gibson, Chillicothe, IL (US); Ankababu Kandlagunta, Peoria, IL (US); Sridhar Thangaswamy, Dunlap, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 204 days.

(21) Appl. No.: 15/404,475

(22) Filed: Jan. 12, 2017

(65) Prior Publication Data

US 2018/0195500 A1 Jul. 12, 2018

(51) Int. Cl.

| | |
|---|---|
| ***F04B 15/08*** | (2006.01) |
| ***F04B 53/04*** | (2006.01) |
| ***F04B 53/16*** | (2006.01) |
| ***F04B 49/00*** | (2006.01) |
| ***F04B 9/117*** | (2006.01) |

(Continued)

(52) U.S. Cl.

CPC ..... *F04B 15/08* (2013.01); *F04B 9/109* (2013.01); *F04B 9/1176* (2013.01); *F04B 23/021* (2013.01); *F04B 49/002* (2013.01); *F04B 49/065* (2013.01); *F04B 53/04* (2013.01); *F04B 53/16* (2013.01); *F04B 53/166* (2013.01); *F04B 2015/081* (2013.01); *F04B 2205/09* (2013.01)

(58) Field of Classification Search

CPC .... F04B 15/08; F04B 9/08; F04B 9/10; F04B 9/103; F04B 9/109; F04B 9/1176; F04B 49/065; F04B 49/002; F04B 23/02; F04B 23/021; F04B 23/023; F04B 53/16; F04B 53/166; F04B 53/04; F04B 2205/09; F04B 2015/081; B60K 2015/03013; F17C 2227/0128; F17C 2227/0135; F17C 2227/0142; F17C 2227/0178; F17C 13/00; F17C 2221/033; F17C 2223/0161; F17C 2265/066; F17C 2270/0165; F17C 2270/0168; F17C 2270/0173; F03C 1/0406; F03C 1/0422; F15B 21/04; F15B 21/042; F15B 21/0423; F15B 21/06

USPC ..... 62/45.1

See application file for complete search history.

(56) References Cited

U.S. PATENT DOCUMENTS

| | | | |
|---|---|---|---|
| 3,818,715 | A | 6/1974 | Scurlock |
| 3,981,628 | A | 9/1976 | Carter |

(Continued)

FOREIGN PATENT DOCUMENTS

| | | | |
|---|---|---|---|
| CN | 202834721 | U | 3/2013 |
| CN | 105422413 | A | 3/2016 |
| GB | 1126751 | A | 9/1968 |

*Primary Examiner* — Devon C Kramer
*Assistant Examiner* — Christopher J Brunjes
(74) *Attorney, Agent, or Firm* — Leydig, Voit & Mayer, Ltd.

(57) ABSTRACT

A cryogenic fluid pump includes an outlet tube extending along the pump centerline, the outlet tube having an outlet passage that is fluidly in communication with the combined outlet and with a pump outlet opening, and a shroud that extends concentrically along the outlet tube and has an inner diameter that is larger than an outer diameter of the outlet tube such that a gap is formed in a radial direction between an inner surface of the shroud and an outer surface of the outlet tube, the gap extending along at least a portion of the outlet tube.

7 Claims, 5 Drawing Sheets

(51) Int. Cl.

| | |
|---|---|
| ***F04B 9/109*** | (2006.01) |
| ***F04B 23/02*** | (2006.01) |
| ***F04B 49/06*** | (2006.01) |

(56) References Cited

U.S. PATENT DOCUMENTS

| | | | | |
|---|---|---|---|---|
| 4,792,289 | A | 12/1988 | Nieratschker | |
| 5,884,488 | A | 3/1999 | Gram et al. | |
| 7,293,418 | B2 | 11/2007 | Nobel et al. | |
| 8,967,502 | B2 | 3/2015 | Kim et al. | |
| 2015/0362128 | A1 | 12/2015 | Sanglan et al. | |
| 2016/0215766 | A1 | 7/2016 | Brown et al. | |
| 2016/0377068 | A1* | 12/2016 | Brown | F04B 23/02 417/53 |
| 2017/0037879 | A1* | 2/2017 | Brown | F04B 15/08 |
| 2017/0058878 | A1* | 3/2017 | Brasche | F04B 37/08 |
| 2017/0335834 | A1* | 11/2017 | Bean | F04B 17/03 |
| 2018/0058218 | A1* | 3/2018 | Bean | F04B 9/103 |

* cited by examiner

CRYOGENIC FLUID PUMP

TECHNICAL FIELD

This patent disclosure relates generally to pumps and, more particularly, to cryogenic fluid pumps.

BACKGROUND

Many large mobile machines such as mining trucks, locomotives, marine applications and the like have recently begun using alternative fuels, alone or in conjunction with traditional fuels, to power their engines. For example, large displacement engines may use a gaseous fuel, alone or in combination with a traditional fuel such as diesel, to operate. Because of their relatively low densities, gaseous fuels, for example, natural gas or petroleum gas, are carried onboard vehicles in liquid form. These liquids, the most common including liquefied natural gas (LNG) or liquefied petroleum gas (LPG), are cryogenically stored in insulated tanks on the vehicles, from where a desired quantity of fuel is pumped, evaporated, and provided to fuel the engine.

The pumps that are typically used to deliver the LNG to the engine of the machine include pistons, which deliver the LNG to the engine. Such piston pumps, which are sometimes also referred to as cryogenic pumps, will often include a single piston that is reciprocally mounted in a cylinder bore. The piston is moved back and forth in the cylinder to draw in and then compress the LNG. Power to move the piston may be provided by different means, the most common being electrical, mechanical or hydraulic power.

One example of a cryogenic pump can be found in U.S. Pat. No. 7,293,418 (the '418 patent), which describes a cryogenic, single-element pump for use in a vehicle. The pump discharges into an accumulator that is located within the tank, and uses a single piston pump that is connected to a drive section via a piston rod. The drive section is disposed outside of the tank.

Pumps such as the pump described in the '418 patent are generally large, heavy and complex, which are due, in part, to the large operating pressures and high volumes of fluid that must be delivered to operate a large displacement engine. Because of the nature of their operation, in that a quantity of fluid is delivered by each stroke, typical systems also require various pressure accumulators and regulators to smooth the supply of gaseous fuel to the engine, which further burdens the vehicles with additional components, cost and complexity.

SUMMARY

In one aspect, the disclosure describes a cryogenic fluid pump. The cryogenic fluid pump includes a plurality of pumping elements, each of the plurality of pumping elements configured to be activated by one of a plurality of pushrods, wherein the plurality of pushrods are arranged in parallel to one another around a pump centerline. The cryogenic fluid pump further includes an activation portion having a housing that includes a plurality of actuators, each actuator configured to activate one of the plurality of pushrods, a manifold having a plurality of passages, each passage fluidly connected to an outlet of a respective one of the plurality of pumping elements, and a combined outlet, which is fluidly open to the plurality of passages and configured to receive a flow of cryogenic fluid provided from the plurality of pumping elements during operation. An outlet tube extends along the pump centerline. The outlet tube has an outlet passage that is fluidly in communication with the combined outlet and with a pump outlet opening. A shroud has a hollow cylindrical shape and extends between the manifold and the activation portion. The shroud extends concentrically along the outlet tube and has an inner diameter that is larger than an outer diameter of the outlet tube such that a gap is formed in a radial direction between an inner surface of the shroud in an outer surface of the outlet tube. The extends along at least a portion of the outlet tube that is disposed between the activation portion and the plurality of pumping elements.

In another aspect, the disclosure describes a cryogenic fluid pump that includes a plurality of pumping elements, each of the plurality of pumping elements configured be activated by one of a plurality of pushrods. The plurality of pushrods is arranged in parallel to one another around a pump centerline. An activation portion has a housing that includes a plurality of actuators, each actuator configured to activate one of the plurality of pushrods. An outlet tube extends along the pump centerline and through the activation portion. The outlet tube has an outlet passage for pressurized cryogenic fluid. An outer sleeve having a hollow cylindrical shape is within the housing, concentrically along the outlet tube such that an outer gap is formed between an inner surface of the outer sleeve and an outer surface of the outlet tube within the housing. One end of each of the plurality of pumping elements is sealably and slidably engaged with the lower portion of the housing. A pair of seals is disposed at a distance to provide a seal between the one end of each of one of the plurality of pumping elements and the housing. A respective passage is formed in the housing to fluidly interconnect the outer gap with each of the distances between each respective pair of seals such that hydraulic fluid leaking past one of the pair of seals into a space between each pair of seals is fluidly communicated to the outer gap.

In yet another aspect, the disclosure describes a method for operating a cryogenic fluid pump. The method includes operating an activation portion of the pump that includes a housing, the activation portion using hydraulic actuators to activate pushrods, the pushrods activating pumping elements immersed in cryogenic fluid, causing a flow of cryogenic fluid to pass through an outlet pipe that extends through the housing of the activation portion of the pump. The method further includes surrounding the outlet pipe with a shroud disposed at a distance from the outlet pipe in a radial direction such that an air gap is formed along the radial direction between an inner surface of the shroud and an outer surface of the outlet pipe, the air gap extending along the outlet pipe at least along a portion thereof that overlaps the activation portion. In accordance with the method, the activation portion of the pump is insulated from the cryogenic fluid flowing through the outlet pipe with the air gap.

Figure 5:
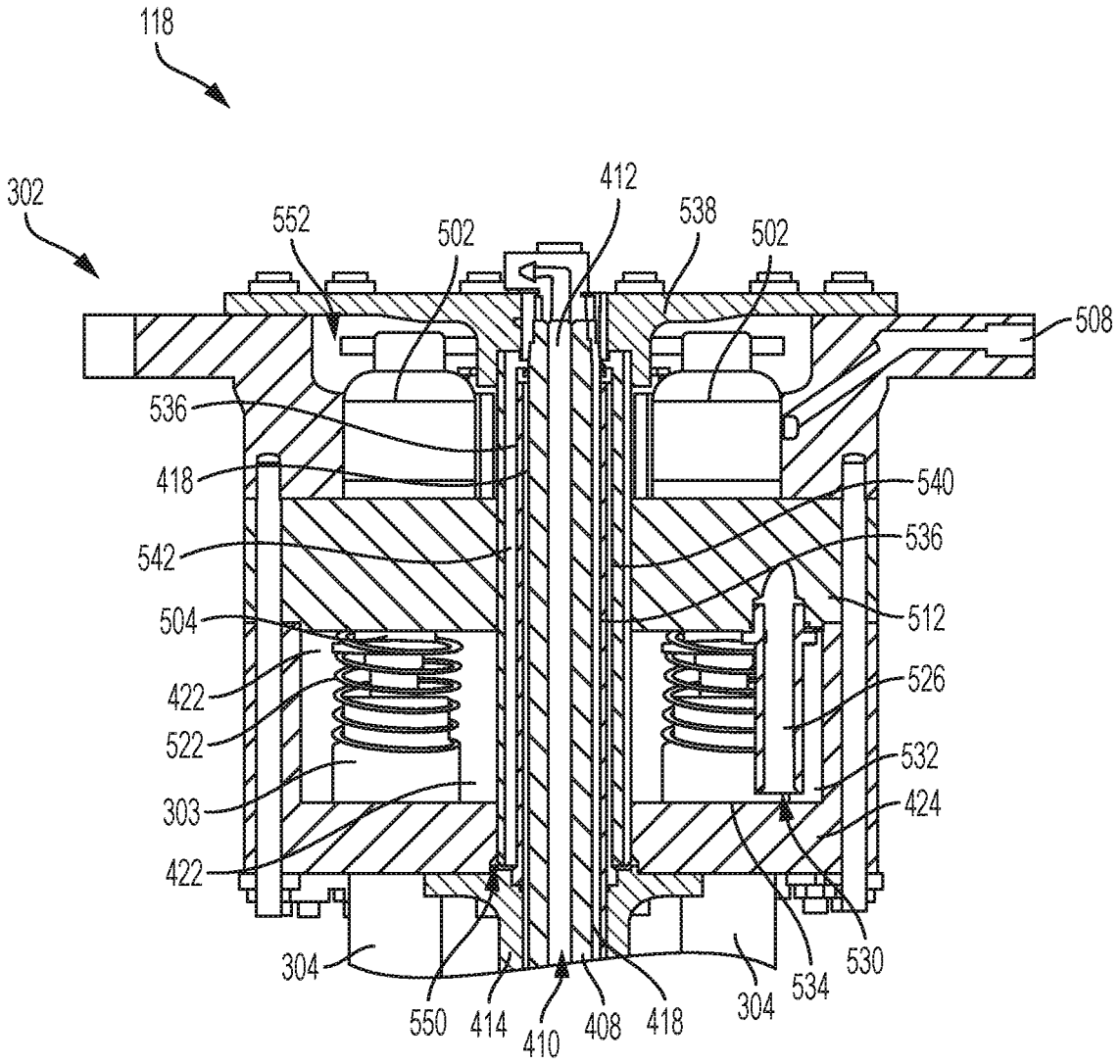
Figure 6:
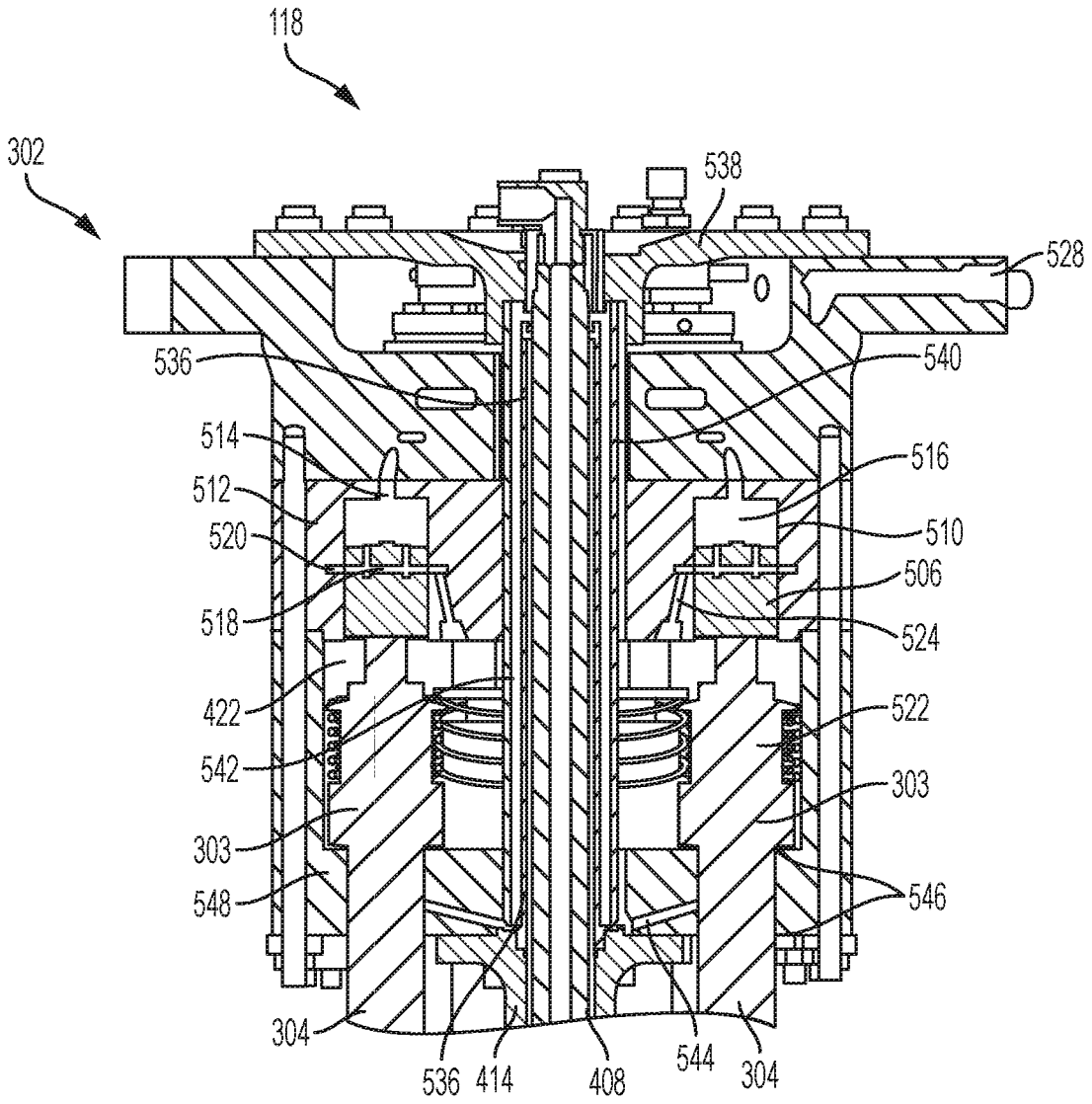

Each of FIGS. 5 and 6 is an enlarged cross section of a drive portion for a cryogenic fluid pump in accordance with the disclosure.

DETAILED DESCRIPTION

Figure 1:
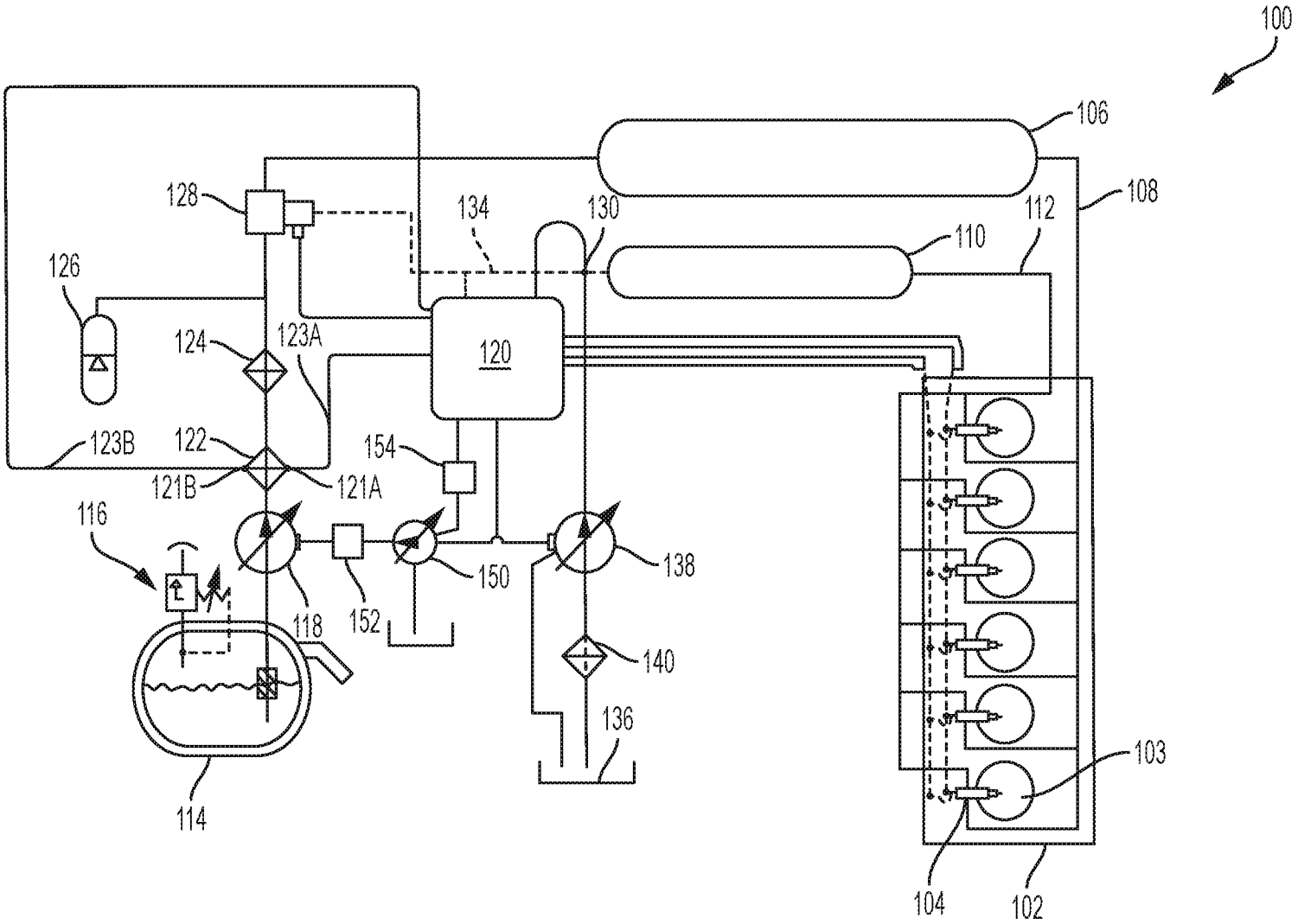
FIG. 1 is a schematic diagram of an engine system having a compressed gas fuel system that includes a gaseous fuel storage tank and corresponding fuel pump in accordance with the disclosure.

This disclosure relates to engines using a gaseous fuel source such as direct injection gas (DIG) or indirect injection gas engines using diesel or spark ignition. More particularly, the disclosure relates to an embodiment for an engine system that includes a gaseous fuel storage tank having a pump that supplies cryogenically stored fluid to fuel an engine. A schematic diagram of a DIG, engine system 100, which in the illustrated embodiment uses diesel as the ignition source, is shown in FIG. 1, but it should be appreciated that indirect injection engines, and/or engines using a different ignition mode are contemplated. The engine system 100 includes an engine 102 (shown generically in FIG. 1) having a fuel injector 104 associated with each engine cylinder 103. The fuel injector 104 can be a dual-check injector configured to independently inject predetermined amounts of two separate fuels, in this case, diesel and gas, into the engine cylinders.

The fuel injector 104 is connected to a high-pressure gaseous fuel rail 106 via a high-pressure gaseous fuel supply line 108 and to a high-pressure liquid fuel rail 110 via a liquid fuel supply line 112. In the illustrated embodiment, the gaseous fuel is natural or petroleum gas that is provided through the high-pressure gaseous fuel supply line 108 at a pressure of between about 10-50 MPa, and the liquid fuel is diesel, which is maintained within the high-pressure liquid fuel rail 110 at about 15-100 MPa, but any other pressures or types of fuels may be used depending on the operating conditions of each engine application. It is noted that although reference is made to the fuels present in the high-pressure gaseous fuel supply line 108 and the high-pressure liquid fuel rail 110 using the words "gaseous" or "liquid," these designations are not intended to limit the phase in which is fuel is present in the respective rail and are rather used solely for the sake of discussion of the illustrated embodiment. For example, the fuel provided at a controlled pressure within the high-pressure gaseous fuel supply line 108, depending on the pressure at which it is maintained, may be in a liquid, gaseous or supercritical phase. Additionally, the liquid fuel can be any hydrocarbon based fuel; for example DME (Di-methyl Ether), biofuel, MDO (Marine Diesel Oil), or HFO (Heavy Fuel Oil).

Whether the engine system 100 is installed in a mobile or a stationary application, each of which is contemplated, the gaseous fuel may be stored in a liquid state in a tank 114, which can be a cryogenic storage tank that is pressurized at a relatively low pressure, for example, atmospheric, or at a higher pressure. In the illustrated embodiment, the tank 114 is insulated to store liquefied natural gas (LNG) at a temperature of about −160° C. (−256° F.) and a pressure that is between about 100 and 1750 kPa, but other storage conditions may be used. The tank 114 further includes a pressure relief valve 116. In the description that follows, a DIG engine system embodiment is used for illustration, but it should be appreciated that the systems and methods disclosed herein are applicable to any machine, vehicle or application that uses cryogenically stored gas, for example, a locomotive in which the tank 114 may be carried in a tender car.

Relative to the particular embodiment illustrated, during operation, LNG from the tank is pressurized, still in a liquid phase, in a pump 118, which raises the pressure of the LNG while maintaining the LNG in a liquid phase. The pump 118 is configured to selectively increase the pressure of the LNG to a pressure that can vary in response to a pressure command signal provided to the pump 118 from an electronic controller 120. The pump 118 is shown external to the tank 114 in FIG. 1 for illustration, but it is contemplated that the pump 118 may at least partially be disposed within the tank 114, as is illustrated in the figures that follow, for example, in FIG. 2. Although the LNG is present in a liquid state in the tank, the present disclosure will make reference to compressed or pressurized LNG for simplicity when referring to LNG that is present at a pressure that exceeds atmospheric pressure.

The pressurized LNG provided by the pump 118 is heated in a heat exchanger 122. The heat exchanger 122 provides heat to the compressed LNG to reduce density and viscosity while increasing its enthalpy and temperature. In one exemplary application, the LNG may enter the heat exchanger 122 at a temperature of about −160° C., a density of about 430 kg/m3, an enthalpy of about 70 kJ/kg, and a viscosity of about 169 μPa s as a liquid, and exit the heat exchanger at a temperature of about 50° C., a density of about 220 kg/m3, an enthalpy of about 760 kJ/kg, and a viscosity of about 28 μPa s. It should be appreciated that the values of such representative state parameters may be different depending on the particular composition of the fuel being used. In general, the fuel is expected to enter the heat exchanger in a cryogenic, liquid state, and exit the heat exchanger in a supercritical gas state, which is used herein to describe a state in which the fuel is gaseous but has a density that is between that of its vapor and liquid phases.

The heat exchanger 122 may be any known type of heat exchanger or heater for use with LNG. In the illustrated embodiment, the heat exchanger 122 is a jacket water heater that extracts heat from engine coolant. In alternative embodiments, the heat exchanger 122 may be embodied as an active heater, for example, a fuel fired or electrical heater, or may alternatively be a heat exchanger using a different heat source, such as heat recovered from exhaust gases of the engine 102, a different engine belonging to the same system such as what is commonly the case in locomotives, waste heat from an industrial process, and other types of heaters or heat exchangers. In the embodiment shown in FIG. 1, which uses engine coolant as the heat source for the heat exchanger 122, a pair of temperature sensors 121A and 121B are disposed to measure the temperature of engine coolant entering and exiting the heat exchanger 122 and provide corresponding temperature signals 123 to the electronic controller 120.

Liquid fuel, or in the illustrated embodiment diesel fuel, is stored in a fuel reservoir 136. From there, fuel is drawn into a fuel pump 138 through a filter 140. The fuel pump 138 may have a variable flow capability to provide fuel to the engine at a variable rate depending on the operating mode of the engine. The rate of fuel provided by the fuel pump 138 can be controlled in response to a command signal from the electronic controller 120. Pressurized fuel from the fuel pump 138 is provided to the high-pressure liquid fuel rail 110. Similarly, the pump 118 has a variable supply capability that is responsive to a signal from the electronic controller 120.

Contaminants may be removed from the gas exiting the heat exchanger 122 by a filter 124. As can be appreciated, the gas passing through the filter 124 may include gas present in more than one phase such as gas or liquid. An optional gas accumulator 126 may collect filtered gas upstream of a pressure regulator 128 that can selectively control the pressure of gas provided to the high-pressure gaseous fuel rail 106 that is connected to the high-pressure gaseous fuel supply line 108. To operate the pump 118, a hydraulic pump 150 having a variable displacement and selectively providing pressurized hydraulic fluid to the pump 118 via a valve system 152 is used. Operation of the hydraulic pump 150 is controlled by an actuator 154 that responds to commands from the electronic controller 120. The valve system 152 also operates in response to commands from the controller 120.

Figure 2:
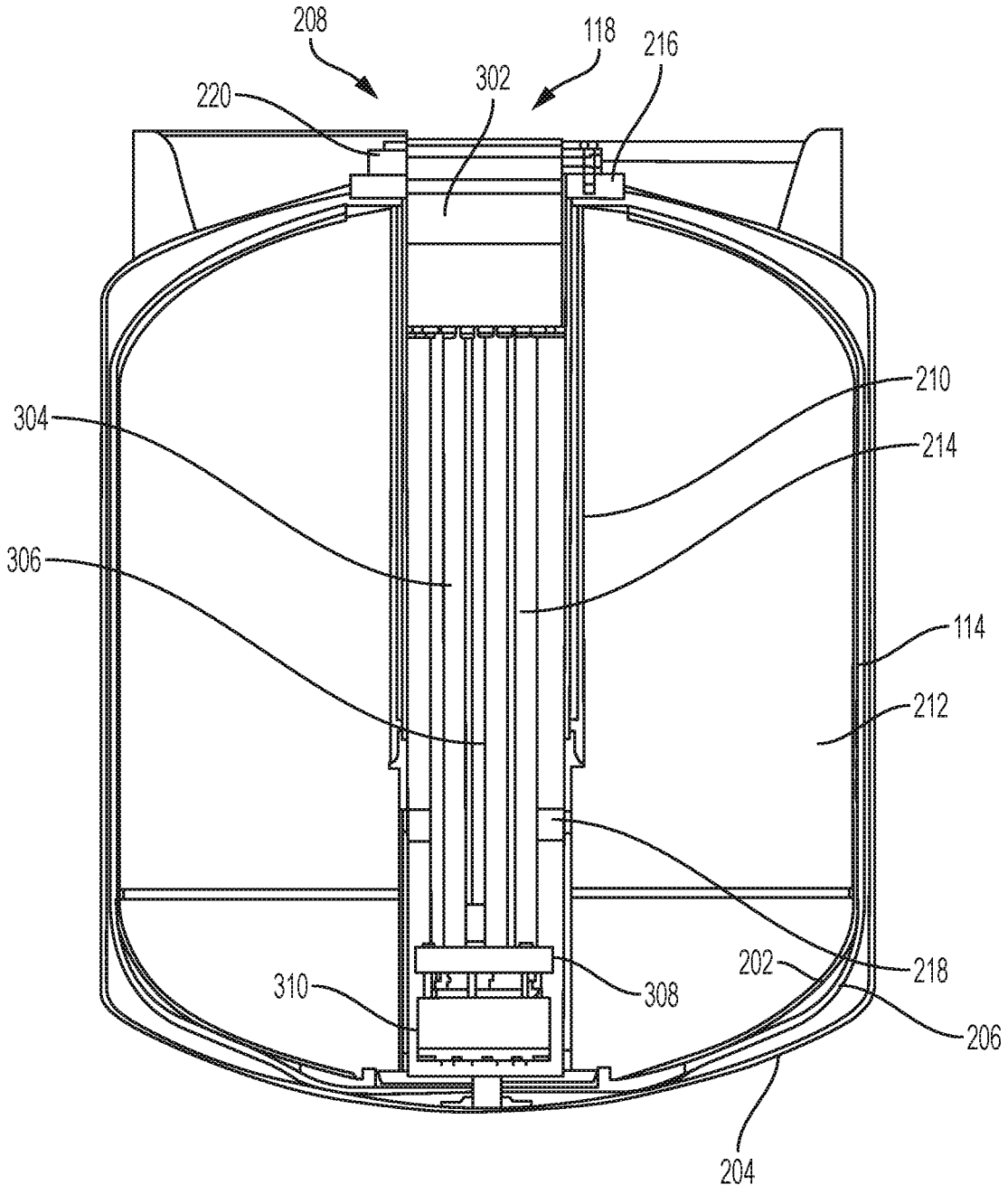
FIG. 2 is a section view of a cryogenic pump in accordance with the disclosure installed into a cryogenic fluid storage tank.

A section view of the tank 114 having the pump 118 at least partially disposed therein is shown in FIG. 2. The tank 114 may include an inner wall 202, which defines a chamber 212 containing the pressurized LNG, and an outer wall 204. A layer of insulation 206 may optionally be used, and/or a vacuum may be created along a gap between the inner wall 202 and the outer wall 204. Both the inner wall 202 and the outer wall 204 have a common opening 208 at one end of the tank, which surrounds a cylindrical casing 210 that extends into a tank interior 212. The cylindrical casing 210 is hollow and defines a pump socket 214 therein that extends from a mounting flange 216 into the tank chamber 212 and accommodates the pump 118 therein. A seal 218 separates the interior of a portion of the pump socket 214 from the tank chamber 212.

Figure 3:
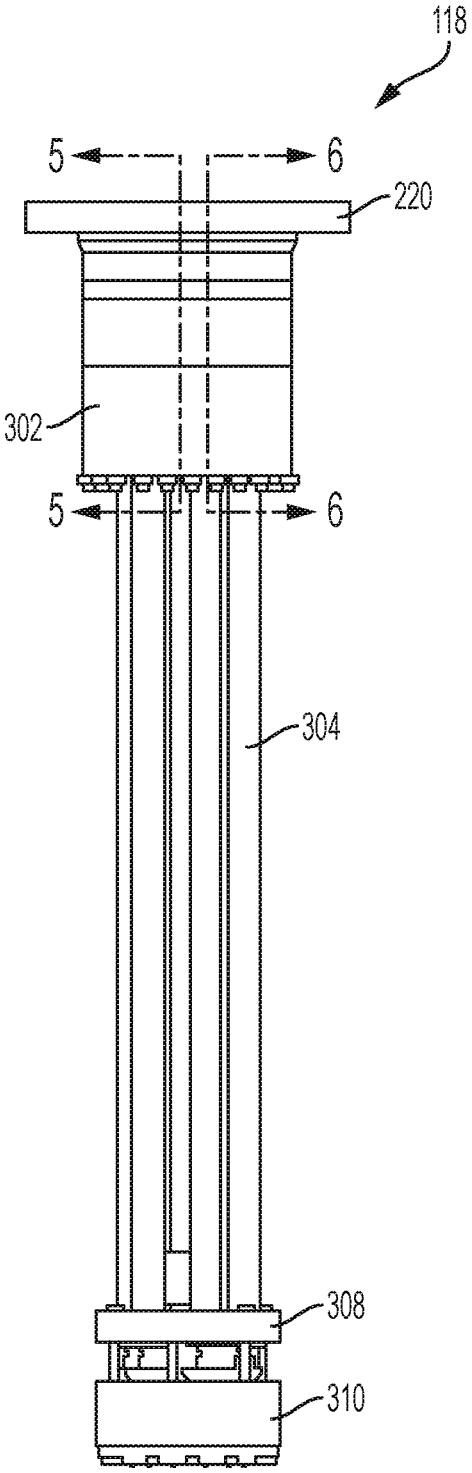
FIG. 3 is an outline view of a cryogenic fluid pump in accordance with the disclosure.

The pump 118 in the illustrated embodiment has a generally cylindrical shape and includes a pump flange 220 that supports the pump 118 on the mounting flange 216 of the tank 114. An outline view of the pump 118, removed from the tank 114, is also shown in FIG. 3, and is partially sectioned to expose internal components in FIG. 4. The pump 118 generally includes an activation portion 302 that operates to selectively activate one or more pushrods 304. The pushrods 304 surround a compression tube 306, which may optionally also operate as an outlet passage for the pump 118. The pushrods 304, which are caused to reciprocate during operation by the activation portion 302, extend from the activation portion 302 to an activation portion 308 that is associated with a pumping portion 310 and, in the illustrated embodiment, are arranged symmetrically around a pump centerline or, at least, a major longitudinal dimension of the pump.

During operation, the pumping portion 310, which may be immersed in cryogenic fluid, operates to pump fluid from the tank interior 212 out of the tank and through an outlet or, in some embodiments, the compression tube 306 to supply the engine with fuel, as previously described. The pumping portion 310 is activated for pumping fluid by the activation portion 308, which in turn translates the reciprocal motion of the pushrods 304 into a pumping action that operates the pumping portion 310. The transmission of the reciprocal motion of the pushrods 304 can be accomplished by any appropriate structures or method including via a solid structure or by another method such as a closed hydraulic or pneumatic volume that can transmit a displacement.

Figure 4:
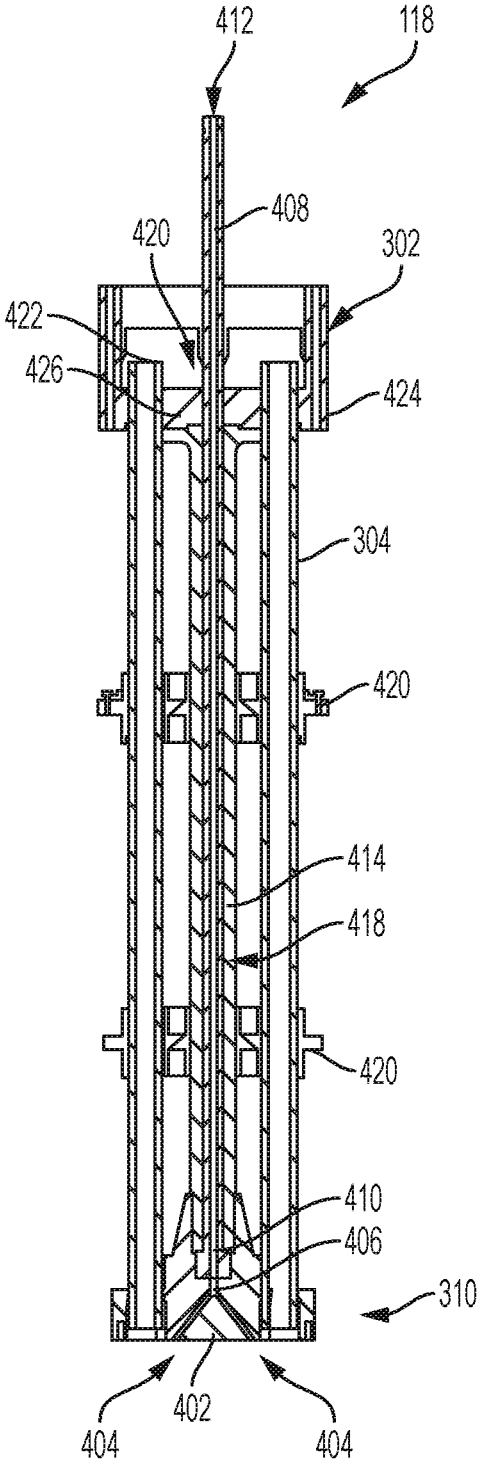
FIG. 4 is a partially disassembled, section view of a cryogenic fluid pump in accordance with the disclosure.

In reference to FIGS. 3 and 4, the pump 118 includes a plurality of pushrods 304 having a top end by the activation portion 302 and a bottom end by the pumping portion 310. As previously described, the pumping elements provide cryogenic fluid at a higher pressure than fluid stored in the tank. The pumped fluid from the various elements is provided to a manifold 402 having passages 404 that are fluidly connected to respective pressurized fluid outlets of the pumping elements. The passages 404 and the manifold 402 converge to a combined outlet 406 that is fluidly in communication with an outlet tube 408. The outlet tube 408 extends from the manifold 402 along the pump centerline and into the activation portion 302 to provide an outlet for pressurized fluid provided by the pump. The outlet tube 408 forms a centrally extending passage 410 that is fluidly connected to the combined outlet 406 and extends up to a pump outlet opening 412. In the embodiment shown, the outlet tube 408 is disposed centrally and in parallel with the pushrods 304.

A shroud 414 may be disposed about the outlet tube 408. The shroud 414 may extend concentrically along the outlet tube 408 such that the outlet tube 408 is disposed along an inner passage 416 of the shroud 414. An inner diameter of the inner passage 416 may be dimensioned such that a gap 418 is formed in a radial direction between an inner wall of the shroud 414 and an outer wall of the outlet tube 408. The gap 418 may have a generally cylindrical shape that extends along a substantial portion of the outlet tube 408 and at least along an upper portion of the outlet tube that extends through the activation portion 302. Spacers 419 may be disposed along the shroud 414 to maintain its spatial relation with respect to the pushrods 304.

The gap 418 is generally empty during normal operation of the pump. In this way, an air cavity is created that provides insulation from the pumped cryogenic fluid within the outlet tube 408 to the various components disposed of the activation portion 302. As can be appreciated, the insulation effect of the gap 418 is provided by the convective insulating properties of the air disposed within the gap 418. In the embodiment shown, the activation portion includes hydraulic spool valves and other actuators that can be sensitive to cold temperatures under certain operating conditions. By insulating the pumped cryogenic fluid flowing through the outlet tube 408, a higher average temperature can be maintained in the activation portion 302 during operation of the pump 118.

Along the top end 420 of the gap 418, the cavity of the gap 418 is sealed from a gallery 422 that may contain hydraulic fluid such that fluid is prevented from entering into the gap 418. A lower housing 424 forms the gallery 422 and also various bores and openings that slidably or statically accommodate the ends of the pushrods and also the outlet tube 408. The top ends of the pushrods 304 include spaced apart seals in the corresponding bores in the lower housing 424. Between the spaced apart seals there is a space or distance between the seals in the pair of seals that is fluidly connected via a corresponding passage 426. During operation, the gallery 422 collects oil from the hydraulic actuators of the pumping elements for draining. In the event of an oil leakage from the spaced apart seal that is in contact with the gallery 422, any oil that leaks along the pushrods past the top seal will be routed to the gap 418 via the corresponding passage 426 rather than allowed to leak into the internal cavity of the cryogenic fluid storage tank.

Enlarged detail cross-sections of the activation portion of the pump 118 are shown in FIGS. 5 and 6, where the various hydraulic actuators are also shown, as well as the connection configurations to the tops of the pushrods 304. In reference to these figures, a hydraulic spool valve 502 is associated with a respective actuator 504, which activates an end 303 of each pushrod 304. The spool valve 502 provides hydraulic fluid to activate a piston 506 (FIG. 6). The hydraulic fluid is provided to the pump through a fluid inlet 508 and selectively distributed through the respective spool valves 502 to the various pistons 506.

As shown in FIG. 6, each piston 506 is slidably disposed in a bore 510 formed in a cylinder housing 512. Each bore 510 defines a cylinder that includes an inlet 514 that selectively, fluidly connects a variable volume 516 with the inlet 508 via the spool valves 502. When each variable volume 516 is exposed to pressurized fluid, the pressure of the fluid causes the piston 506 to extend and push the pushrod 304 to activate a pumping element in the pumping portion 310. When the piston 506 has extended a desired distance along the bore 510, a passage 518 formed in the piston 506 aligns with an annular passage 520 formed in the cylinder housing 512 to fluidly connect the annular passage 520 with the variable volume 516. The relative axial position of the annular passage 520 and the piston 506 when the passage 518 aligns with the annular passage 520 determines a maximum activation distance for the piston and, thus, the pushrod. A return spring 522 acts to counter the hydraulic force of the piston 506 when the piston is extended and limits travel of the piston when the hydraulic force is removed. Each of the annular passages 520 is vented to the gallery 422 via a respective conduit 524.

The gallery 422 may be configured to collect vented hydraulic fluid from the various bores 510. In the illustrated embodiment, hydraulic fluid vented and collected into the gallery 422 may be drained by a drainage conduit 526 (FIG. 5) that is fluidly connected to a low pressure fluid return outlet 528 (FIG. 6) of the pump 118. The drainage conduit 526 has an inlet opening 530 that extends into the gallery 422 and is disposed at a small gap 532 from a floor surface 534 of the gallery 422 such that, during operation, the drainage conduit 526 acts as a sump to remove fluid from the gallery 422 and minimize the amount of fluid that may remain in the gallery 422. It has been found that fluid such as oil that may remain in the gallery 422 during operation may cool by conduction and convection from the cryogenic fluid passing through the passage 410. Such cooling may increase the viscosity of the fluid, and potentially impede normal oil flow through the pump 118. Moreover, a constant flow of oil through the pump will also heat the various portions of the pump that come in contact with the fluid, e.g., the various pump structures surrounding the gallery 422, and provide a desirable or maintainable pump temperature at the activation portion of the pump while the pump is operating.

In reference now to FIG. 5, it can be seen that that the outlet tube 408 extends past a top end of the shroud 414 as the outlet tube 408 passes through the activation portion 302. To preserve the gap 418 and the insulation it provides, an inner sleeve 536 may be disposed concentrically around the outlet tube 408 in abutting relation with a top end of the shroud 414 to form an extension thereof that extends axially from a lower end of the activation portion 302 to a top end or cap 538 of the activation portion 302. Although in the illustrated embodiment the tube is shown as a separate part, it should be appreciated that the inner sleeve 536 and the shroud 414 can be formed as a single, integral part.

In reference now to FIG. 6, it is shown that an outer sleeve 540 is disposed concentrically around the inner sleeve 536 and the portion of the outlet tube 408 that extends into the activation portion of the pump. More specifically, an outer sleeve 540 having a hollow cylindrical shape is disposed concentrically along the hollow, cylindrical inner sleeve 536. Based on this placement, an outer gap 542 is formed in a radial direction between an outer surface of the inner sleeve 536 and an inner surface of the outer sleeve 540. As is also shown in FIG. 6, a passage 544 fluidly connects the outer gap 542 with an area between a pair of radial seals that prevent hydraulic fluid from the gallery 422 from leaking through an interface between the top and 303 of the pushrods 304 and an area below the pump and within the tank as previously described.

As can be seen from FIG. 6, a pair of radial seals can be disposed at areas 546 along the top end 303 of the pushrods 304 and a cup-shaped housing 548 of the activation portion 302 of the pump 118. The cup-shaped housing 548 at least partially forms the gallery 422, in which hydraulic fluid is present during operation. Any hydraulic fluid from the gallery 422 that leaks past the top seal 546 will enter a space between the two seals and collect in the passage 544. Passing through the passage 544, leaking hydraulic fluid reaches the outer gap 542 through a slot opening 550 and from there is vented through a vent opening in the pump (not shown). In one embodiment, hydraulic fluid from the outer gap 542 can be collected and vented through the low pressure fluid return outlet 528. The outer sleeve 540 also prevents hydraulic fluid from the gallery 422 from entering into a top portion 552 of the activation portion 302 that encloses the electronic parts and solenoids associated with the spool valves 502.

INDUSTRIAL APPLICABILITY

The present disclosure is applicable to any type of application that involves a liquefied gas storage tank. In the illustrated embodiment, a machine having a LPG fuel source that is carried in an on-board tank was used for illustration, but those of ordinary skill in the art should appreciate that the methods and systems described herein have universal applicability to any type of compressed gas tank that includes a pump for pumping liquefied gas from the tank to supply a system such as an engine with gas.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A cryogenic fluid pump, comprising:

a plurality of pumping elements, each of the plurality of pumping elements configured to be activated by one of a plurality of pushrods, wherein the plurality of pushrods are arranged in parallel to one another around a pump centerline;

an activation portion having a housing that includes a plurality of actuators, each actuator configured to activate one of the plurality of pushrods;

an outlet tube extending along the pump centerline and through the activation portion, the outlet tube having an outlet passage for pressurized cryogenic fluid;

an outer sleeve disposed within the housing concentrically along the outlet tube such that an outer gap is formed between an inner surface of the outer sleeve and an outer surface of the outlet tube;

wherein one end of each of the plurality of pushrods is sealably and slidably engaged with a lower portion of the housing, wherein a pair of seals is disposed at a distance from one another, the pair of seals providing a sealing function between the one end of each of the plurality of pushrods and the housing; and wherein a respective passage is formed in the housing to fluidly interconnect the outer gap with each of the distances between each respective pair of seals such that hydraulic fluid leaking past one of the pair of seals into a space between each pair of seals is fluidly communicated to the outer gap.

2. The cryogenic fluid pump of claim 1, wherein the housing forms a vent opening that is fluidly connected to the outer gap.

3. The cryogenic fluid pump of claim 1, further comprising an inner sleeve disposed at a distance between the outer surface of the outlet tube and the inner surface of the outer sleeve, wherein the outer gap is defined between the inner sleeve and the outer sleeve, and wherein an inner gap is defined between the outlet tube and the inner sleeve.

4. The cryogenic fluid pump of claim 3, further comprising a lower seal disposed between the inner sleeve in the housing, and an upper seal disposed between the inner sleeve and the outlet tube such that the inner gap forms a sealed cavity that thermally insulates the outlet tube from the activation portion of the pump.

5. The cryogenic fluid pump of claim 3, wherein each of the outlet tube and the inner sleeve has a substantially cylindrical shape such that the inner gap has a generally hollow cylindrical shape and occupies a space between an inner surface of the inner sleeve and the outer surface of the outlet tube.

6. The cryogenic fluid pump of claim 1, wherein the housing includes a cup-shaped member that defines a gallery.

7. The cryogenic pump of claim 6, further comprising a drainage conduit disposed in the cup-shaped member and in fluid communication with the gallery, the drainage conduit including an inlet opening that extends into the gallery and is disposed at a distance from a floor surface of the gallery such that, during operation, the drainage conduit acts as a sump to remove hydraulic fluid from the gallery.

* * * * *